US005116260A

United States Patent [19]

Upchurch

[11] Patent Number: 5,116,260

[45] Date of Patent: May 26, 1992

[54] LINE HANDLING DEVICE

[76] Inventor: Paul E. Upchurch, 2082 W. Pinewood Way, Oak Harbor, Wash. 98277

[21] Appl. No.: 706,865

[22] Filed: May 29, 1991

[51] Int. Cl.[5] ..... B63B 21/54

[52] U.S. Cl. ..... 114/221 R; 114/230; 294/19.1

[58] Field of Search ..... 294/19.1; 114/230, 221 R

[56] References Cited

U.S. PATENT DOCUMENTS

| | | | |
|---|---|---|---|
| 149,575 | 4/1874 | Clendaniel et al. | 294/19.1 |
| 2,040,769 | 5/1936 | Fitzgibbon | 114/230 |
| 2,116,880 | 5/1938 | Lee | 294/19.1 |
| 2,560,622 | 7/1951 | Abramowski | 43/9 |
| 2,811,127 | 10/1957 | Palsson | 114/230 |
| 3,072,429 | 1/1963 | Stipan | 294/19 |
| 3,677,597 | 7/1972 | Stipek | 294/19.1 |
| 3,841,685 | 10/1974 | Kołodziej | 294/19.1 |
| 3,872,834 | 3/1975 | Fuhrman | 119/151 |
| 3,893,005 | 7/1975 | Corbin | 317/2 E |
| 3,945,355 | 3/1976 | Kratz | 114/230 |
| 4,200,053 | 4/1980 | Vall | 114/230 |
| 4,635,986 | 1/1987 | Johns | 294/19.1 |
| 4,793,646 | 12/1988 | Michard, Jr. | 114/221 R |
| 4,809,635 | 3/1989 | Essig | 114/230 |
| 4,932,700 | 6/1990 | Hart | 294/19.1 |
| 4,986,207 | 1/1991 | Reed | 114/211 R |
| 5,009,181 | 4/1991 | Upchurch | 114/221 R |

FOREIGN PATENT DOCUMENTS

| | | |
|---|---|---|
| 3508470A1 | 9/1986 | Fed. Rep. of Germany . |
| 1377764 | 12/1974 | United Kingdom . |

*Primary Examiner*—Edwin L. Swinehart
*Attorney, Agent, or Firm*—Seed and Berry

[57] ABSTRACT

An apparatus to assist a user in tying a boat to a cleat or rail. In one embodiment, the apparatus includes a line having a loop and a pair of spreaders which are independently, slidably mounted thereon. Each spreader has a connection recess to receive an end portion of one of a pair of spaced-apart spreader arms. The spreader arms are attached to one end of an elongated shaft and the other end of the shaft is for grasping by the user. The spreaders hold the loop in an open position for easy placement around the cleat and when the handle is pulled by the user in a direction away from the cleat with a predetermined separation force, with the loop in place around the cleat, the spreaders separate from the spreader arms and the loop is free to assume a closed position around the cleat for tying the boat to the cleat. In an alternative embodiment, the line has a pair of spliced end portions, each of which is fixedly attached to one of the spreaders. Each spreader has a hook fixedly attached thereto for grasping a mooring rail.

43 Claims, 4 Drawing Sheets

FIG.1
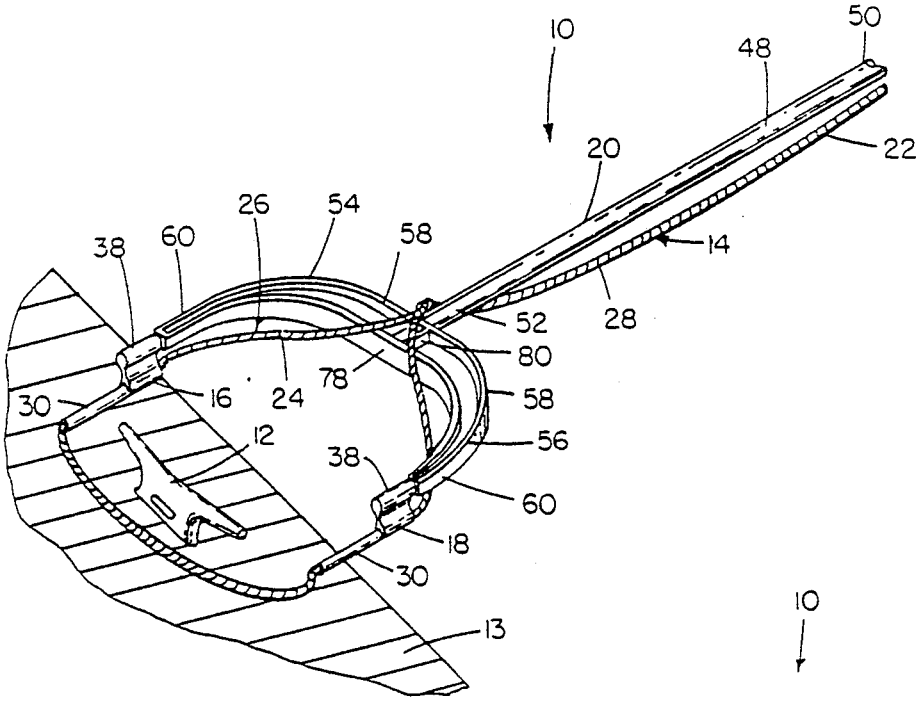
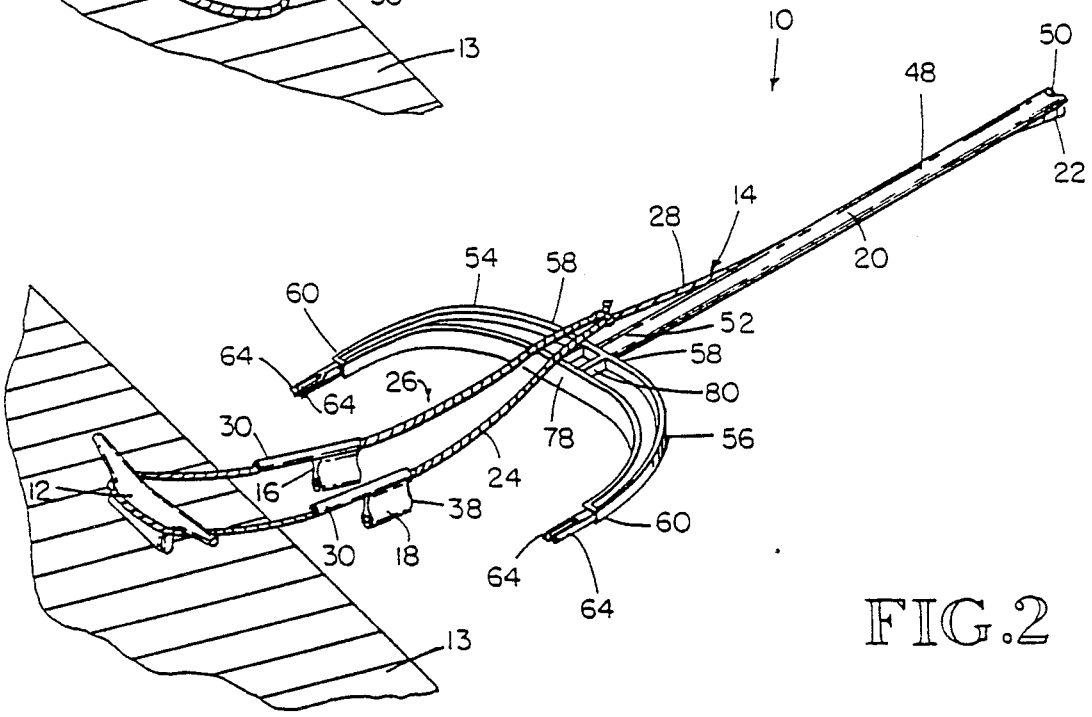
FIG.2

FIG. 3
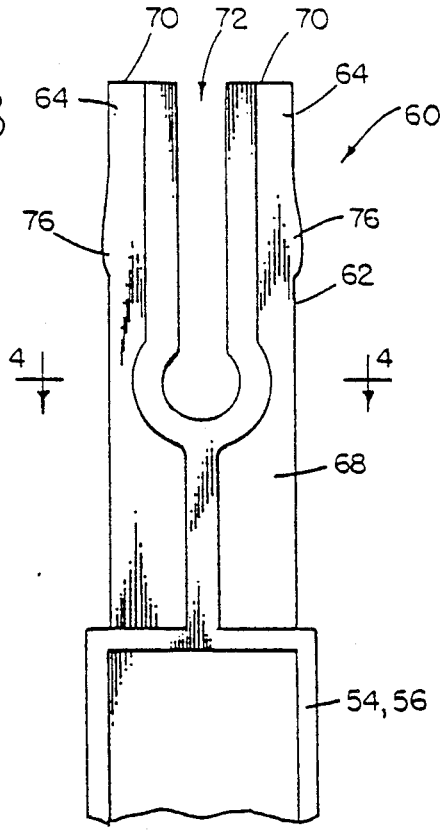
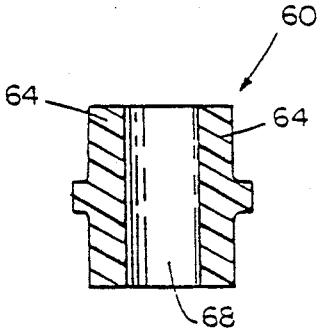
FIG. 4
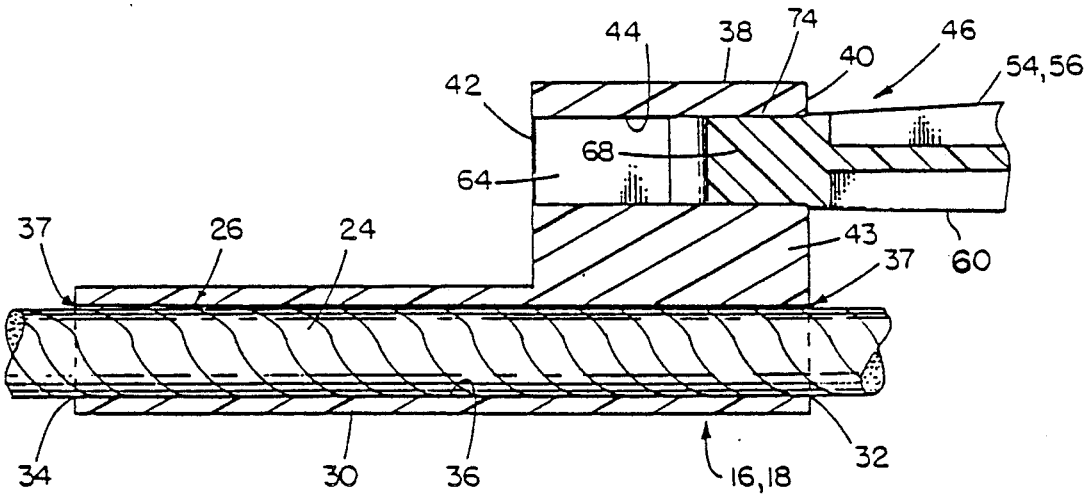
FIG. 5

FIG.6
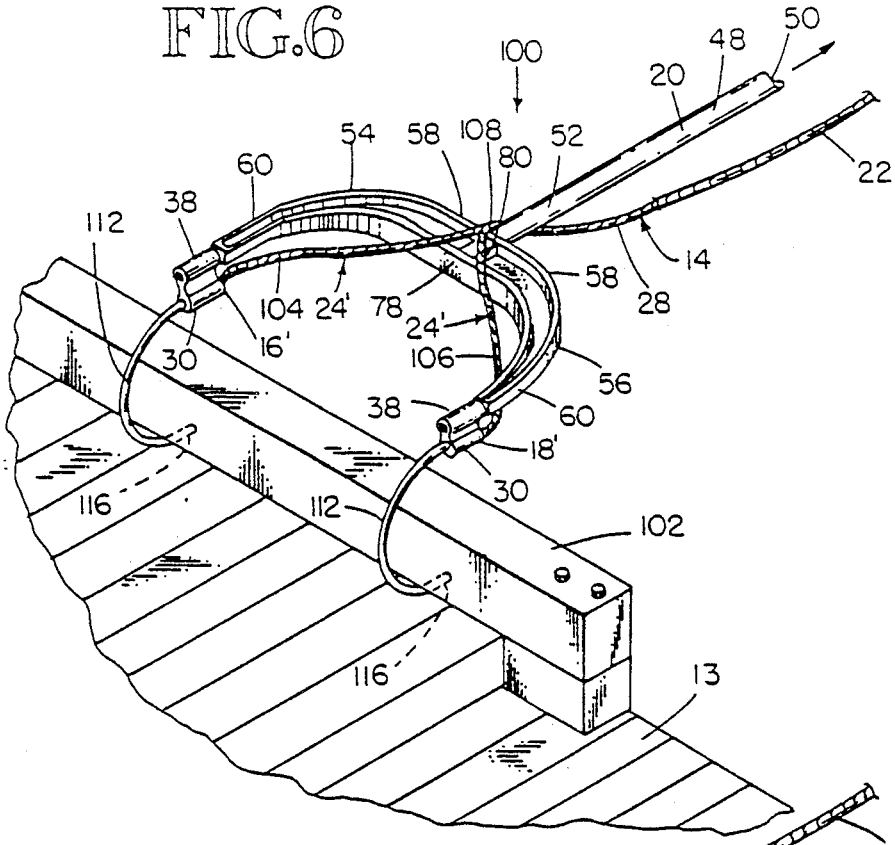
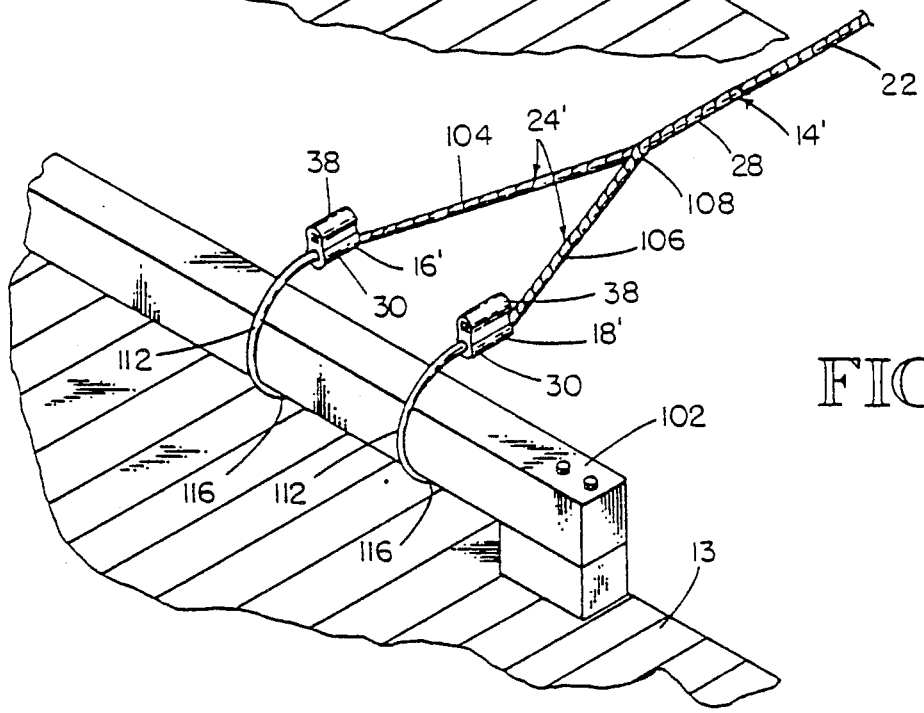
FIG.7

LINE HANDLING DEVICE

TECHNICAL FIELD

The present invention relates generally to boat line handling apparatus, and more particularly to a device for assisting a boater in mooring to a mooring rail.

SUMMARY OF THE INVENTION

Generally, when a boater attempts to moor his boat, he uses a line with a loop at one end. As the boat approaches the dock to which he desires to motor the boat, the boater usually jumps to the dock and places the loop of the line around a mooring cleat. Since it is sometimes not possible to jump from the boat, such as when there is no crew to assist with the mooring, or the size of the boat or the roughness of the water prevents safe jumping from the boat to the dock, or the person handling the line is physically unable to make the jump, it is necessary to throw the loop over the cleat. It takes a high level of skill and usually a great deal of luck to successfully throw the loop over the cleat. Often, multiple throws are required. This can be a time-consuming and frustrating endeavor. If the water is rough, the wind high, or the boat approaching the dock at too high of a speed, it is necessary to very quickly place the loop over the cleat so that the boat can be tied up before the boat collides with nearby boats or the dock. A similar problem is encountered when attempting to moor a boat to a dock that utilizes a mooring rail rather than cleats. In this situation, it is almost impossible to secure a line to the rail without having assistance on the dock or leaving the boat to personally tie the line to the rail.

While various devices have been designed in the past to assist the boater in placing the loop over a cleat or other object to which the boat is to be tied, all such devices have had serious drawbacks. There is a need for an easy-to-use apparatus to assist the boater in tying his boat to a cleat, a rail, and other objects. In the case of a cleat, such a device should hold the loop in a very wide-open position to facilitate placement of the loop around the cleat, and then permit quick and easy closing of the loop around the cleat. In the case of a rail, such a device should facilitate quick attachment of the line to the rail. The device should include a long handle which allows the boater to place the loop over the cleat or attach the line to the rail while on the boat at a substantial distance from the dock. The handle should be disconnectable from the line so that the line can be used for permanent mooring of the boat without replacing it with another line, and without the handle interfering with the final mooring process. The device should securely hold the line until the boater is ready to disconnect the handle from the line to prevent the line from accidentally separating from the handle. The device should also be uncomplicated in design, inexpensive to manufacture and convenient to use. The present invention fulfills these needs, and further provides other related advantages.

SUMMARY OF THE INVENTION

The apparatus of the present invention includes a line having a first end portion attachable to the boat, a second end portion having first and second end segments, each with a free terminal end portion, and a length of line extending between the first and second end portions. Alternatively, an existing line can be used with the invention.

The apparatus further includes first and second spreaders, each disconnected from the other. In the preferred embodiment, each spreader has an aperture into which the terminal end portion of the corresponding line first and second end segment extends and is secured therewithin. The first and second spreaders each have a hook sized to reach at least partially around the mooring rail or other object to which the boat is to be moored.

In the preferred embodiment of the invention, the apparatus also includes a handle having a shaft with a proximal end portion for grasping by the user and a distal end portion. Alternatively, an existing handle or boat hook can be used.

The apparatus has a pair of spreader arms, with each spreader arm having one end rigidly attached to the shaft distal end portion and a free end spaced apart from the free end of the other of the spreader arms by a predetermined distance The free end of each of the spreader arms is releasably connected to a different one of the first and second spreaders to selectively hold the first and second spreaders spaced apart by about the predetermined distance. In the preferred embodiment, the free ends of the spreader arms are selectively disconnectable from the first and second spreaders in response to the user pulling the handle in a direction away from the object with a predetermined separation force with the hooks in place around the object. This allows the hooks to remain hooked around the object during mooring uninhibited by the first and second spreaders or the spreader arms. Alternatively, other means for disconnecting the first and second spreaders from the spreader arms may be utilized.

With the present invention, the user, while located at a distance from the object and holding the proximal end of the shaft, can easily place the hook around the object. He can then selectively disconnect the first and second spreaders from the spreader arms by pulling on the handles toward him.

The first and second spreaders each has a line-retaining member with spaced-apart first and second ends. The aperture extends fully between the first and second member ends. The terminal end portion of the line first and second end segments extend into the apertures from openings at the first member end toward the spreader arms, and the first and second spreader hooks extend into the apertures from openings at the second member end away from the spreader arms. The spreader arms are oriented relative to each other to hold the hooks in a spaced apart, substantially parallel alignment with each other, and the second member ends are positioned away from the spreader arms. In this manner, the hooks are held extending in the direction away from the spreader arms when the free ends of the spreader arms are inserted within corresponding recesses of the first and second spreaders.

The first and second spreaders also include an elongated engagement member with first and second longitudinal ends. The recesses each are a longitudinally extending cavity with an opening at the first engagement member end toward the spreader arms. The free ends of the spreader arms are each an elongated insertion member sized to be inserted into one of the openings of the engagement members and to be tightly retained within the recess. Each of the engagement members is rigidly connected to one of the line-retaining members in substantially parallel alignment therewith.

In the preferred embodiment, the free ends of the spreader arms are formed with a pair of resilient fingers sized to be inserted into one of the recesses by yielding movement of the fingers together. The fingers can also each include a detent engaging one of the spreaders when the fingers are inserted into the recesses.

Other features and advantages of the invention will become apparent from the following detailed description, taken in conjunction with the accompanying drawings.

BRIEF DESCRIPTION OF THE DRAWINGS

FIG. 1 is a perspective view of a first embodiment of the present invention, showing the apparatus with a mooring line loop placed around a cleat.

FIG. 2 is a perspective view of the apparatus of FIG. 2, shown with the loop in a closed position around the cleat.

FIG. 3 is an enlarged, fragmentary view of one free end portion of a spreader arm of the invention shown in FIG. 1.

FIG. 4 is a sectional view taken substantially along the lines 4—4 of FIG. 3.

FIG. 5 is an enlarged, elevational cross section of one of the spreaders shown in FIG. 1.

FIG. 6 is a perspective view of an alternative second embodiment of the present invention, showing the apparatus with a mooring line hooked around a mooring rail.

FIG. 7 is a perspective view of the apparatus of FIG. 6, shown with hooks of the apparatus secured to the rail.

DETAILED DESCRIPTION OF THE INVENTION

Figure 8:
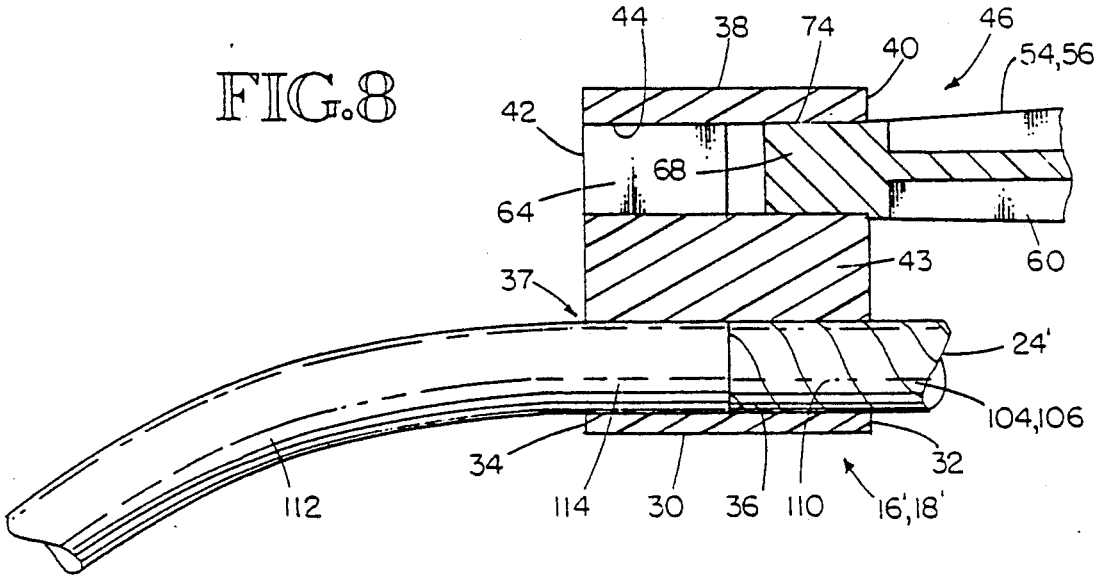
FIG. 8 is an enlarged, elevational cross section of one of the spreaders shown in FIG. 6.

As shown in the drawings for purposes of illustration, the present invention is embodied in an apparatus, indicated generally by reference numeral 10, to assist a user in tying a boat (not shown) to a cleat 12 fixed to a dock 13 or to other objects, such as a piling. The apparatus 10 includes a line 14, first and second spreaders 16 and 18, respectively, and a handle 20 to which the first and second spreaders are removably attached. As will be described in more detail below, the handle can be grasped by the user to assist him in placing the line around the cleat 12 without leaving the boat when the boat is still a distance from the dock 13.

The line 14 has a first end portion 22 attachable to the boat and a second end portion 24 forming a loop 26 sized to be placed around the cleat 12, and a length of line 28 extending between the first and second end portions.

Each of the first and second spreaders 16 and 18 is disconnected from the other so as to be separately movable. As shown in more detail in FIG. 5, each spreader includes an elongated, tubular, line-retaining member 30 with first and second longitudinal ends 32 and 34, respectively, which are spaced apart by a predetermined amount. An aperture 36 extends fully between the line-retaining member first and second ends 32 and 34 to provide an opening 37 at the first and second ends of each of the first and second spreaders through which the second end portion 24 of the line 14 passes. The aperture 36 is sized to slidably receive therethrough the second end portion 24 of the line. With this arrangement, each of the first and second spreaders 16 and 18 is independently, slidably mounted on the second end portion 24 of the line which forms the loop 26 so that the first and second spreaders can be selectively moved to opposite sides of the loop for connection to the handle 20.

The first and second spreaders 16 and 18 also each includes an elongated, tubular engagement member 38 with first and second longitudinal ends 40 and 42, respectively. The engagement member 38 is fixedly attached to the corresponding retaining member 30 of the spreader by a support rib 43 which holds the engagement member in a substantially parallel, spaced-apart, fixed relation to the line-retaining member. A connection recess 44 extends longitudinally from the engagement member first end 40 at least partially to the engagement member second end 42 to provide a longitudinally extending cavity with an opening 46 at the engagement member first end 40.

The handle 20 includes an elongated shaft 48 with a proximal end portion 50 for grasping by the user and a distal end portion 52. A pair of spreader arms 54 and 56 each have one end 58 rigidly attached to the shaft distal end portion 52 and a free end 60 spaced apart from the free end of the other of the spreader arms by a predetermined distance. In the preferred embodiment of the invention, the free ends 60 of the spreader arms 54 and 56 are each releasably insertable into the recess 44 of a different one of the first and second spreaders 16 and 18 when the first and second spreaders are positioned to opposite sides of the loop 26 and spaced apart by about the predetermined distance for the spreader arms. In this manner, the spreader arms 54 and 56 selectively hold the loop 26 in an open position.

The free ends 60 of the first and second spreader arms 54 and 56 are releasable from the recesses 44 of the first and second spreaders 16 and 18 in response to the user pulling the handle 20 in a direction away from the cleat 12 with the loop 24, when held in an open position, in place around the cleat. When a predetermined separation force is exceeded, the free ends 60 of the spreader arms 54 and 56 will be released from the recesses 44 of the first and second spreaders 16 and 18, and allow the loop 26 to assume a closed position around the cleat uninhibited by the first and second spreaders or by the spreader arms, as shown in FIG. 2. In such manner, the user can easily place the loop 26 around the cleat 12 and selectively disconnect the first and second spreaders 16 and 18 from the spreader arms 54 and 58 while still standing on the boat by pulling on the proximal end portion 50 of the shaft 48 so the loop can assume a closed position around the cleat for tying the boat to the cleat.

In the preferred embodiment of the invention, as best shown in FIGS. 3 and 4, the free ends 60 of the spreader arms 54 and 56 are each sized to be inserted into the opening 46 of one of the engagement members 38 and to be tightly retained within the recess 44. The spreader arms 54 and 56 are oriented relative to each other to hold the line-retaining members 30 of the first and second spreaders 16 and 18 in a spaced-apart, substantially parallel alignment having their first ends 32 positioned toward the spreader arms and their second ends 34 positioned away from the spreader arms when the free ends 60 of the spreader arms are inserted within the recesses 44 of the first and second spreaders. The first end 40 of the engagement member 38 at which the openings 46 of the recesses 44 are located is positioned toward the corresponding one of the spreader arms 54 and 56. As such, the loop 26 is held open in the direction from the first end 32 to the second end 34 of the line-retaining members 30 by at least the predetermined amount the first and second ends are spaced apart.

The line-retaining member 30 projects from its first end 32, which is also positioned toward the spreader arm, a desired distance beyond the engagement member second end 42 and terminates at its line-retaining member second end 34 to position the line-retaining member second end of each of the first and second spreaders 16 and 18 beyond the engagement member second ends 42. By elongating the line-retaining members 30, the opening of the loop 26 is increased by the desired distance in the direction the user will typically reach with the apparatus 10 when attempting to place the loop 26 around the cleat 12 when the boat is at a distance from the dock 13. The spacing between the first and second spreaders 16 and 18 is determined by the spacing between the free ends 60 of the spreader arms 54 and 58. This determines the width of the loop 26.

In the preferred embodiment of the invention, each of the free ends 60 of the spreader arms 54 and 56 is formed as a pair of resilient fingers 64 which are attached together at a common base portion 68. Each of the fingers 64 has a free end portion 70. The fingers 64 are spaced apart by a lateral distance 72 along their full length. The fingers 64 are sized and spaced apart to be insertable into the recess 44 of the engagement member 38 of the corresponding one of the first and second spreaders 16 and 18. The fingers 64 are sufficiently resilient to allow yielding movement of the fingers together when inserted into the recess 44, but have sufficient resiliency to move the fingers apart once inside the recess to resiliently grasp an interior wall 74 of the recess to prevent removal of the fingers therefrom until the predetermined separation force is exerted thereon. In the presently preferred embodiment, each of the fingers 64 has a detent 76 which engages the interior wall 74 of the recess 44 when the fingers are inserted therein.

It is to be understood that other means may be used to permit selective disconnection of the first and second spreaders 16 and 18 from the spreader arms 54 and 56, such as a latch or other locking mechanism which can be activated by the user in any convenient manner.

It is desirable to prevent rotation of the first and second spreaders 16 and 18 on the spreader arms 54 and 56 when the free ends 60 of the spreader arms are inserted into the recesses 44 of the engagement members 38. To accomplish this, the interior wall 74 of the recesses 44 has a non-symmetrical rectangular cross-section, and the free ends 60 of the spreader arms 54 and 56 each has a cross-sectional shape and size to engage the interior wall 74 and prevent rotation of the spreader arms when within the recesses. In the presently preferred embodiment of the invention, the free ends 60 of the spreader arms have a generally rectangular cross-section as shown in FIG. 4, which corresponds to the rectangular cross-section of the recesses 44.

The shaft 48 and the spreader arms 54 and 56 are removably attached together so that the handle 20 can be broken down into at least two parts for storage. In the preferred embodiment, the spreader arms 54 and 56 have, in combination, a "U" shape with a base portion 78. The shaft distal end portion 52 is removably attached to the spreader arms 54 and 56 at the base portion 78 by a snap coupling 80. The base portion 78 includes an insert (not shown) which can be snapped into place within a recess (not shown) in the shaft distal end portion 52, and selectively removed in a conventional manner when the user decides to break the handle down.

With the present invention, the user can quickly and more reliably, in a safer manner and with less effort, accomplish placing the loop 26 of the line 14 around the cleat 12 for mooring purposes while the boat is at a distance from the dock 13 using the long reach provided by the handle 20 of the apparatus 10. The user no longer has to jump to the dock or attempt to lasso the cleat. The operation of the apparatus 10 is simple and requires no training or special skills. Further, the apparatus 10 of the present invention has an uncomplicated construction and can be manufactured in an economical manner. The apparatus 10 can also be broken down for easy storage.

The apparatus 10 can be sold for use with an already existing line provided by the user so that the user simply needs to buy the first and second spreaders 16 and 18 and place them on the loop of the mooring line he already owns, and buy the handle 20 having the spreader arms 54 and 56. Alternatively, the spreader arms 54 and 56 can be manufactured for connection to a handle, boat hook or other pole already owned by the user. In any event, when assembled, the utilitarian features of the, resulting device will be substantially as described and shown herein.

An alternative embodiment of the invention is shown in FIGS. 6–8. For ease of understanding and brevity, the components of this alternative second embodiment will be similarly numbered with those of the first embodiment when of a similar construction Only the differences in construction will be described in detail.

In the second embodiment, the apparatus is indicated generally by reference numeral 100, and is designed to assist a user in tying a boat (not shown) to a mooring rail 102 fixed to the dock 13. As with the first embodiment, the apparatus 100 uses the line 14', first and second spreaders 16' and 18', respectively, and a handle 20 to which the first and second spreaders are removably attached. In the second embodiment, the line 14' has the first end portion 22 attachable to the boat, and first and second end segments 104 and 106 which are spliced together at point 108 to define a second end portion 24'. The length of line 28 extends between the first and second end portions 22 and 24'.

Each of the first and second spreaders I6' and 18' is disconnected from the other so as to be separately movable. Unlike with the tubular, line-retaining members 30 of FIG. 1, the first and second end segments 104 and 106 of line 14' are not slidably received in the aperture 36 of the line-retaining member 30. Instead, as best illustrated in FIG. 8, the terminal end portion 110 of each of the first and second line end segments 104 and 106 extends into the first end 32 of the corresponding line-retaining member 30 and is fixedly secured within the aperture 36 against removal.

Each of the line-retaining members 30 also has a hook 112. A terminal end portion 114 of the hook 112 projects into the second end 34 of the aperture 36 of the line-retaining member 30 and is fixedly secured therein. The hook 112 is manufactured from, a thickwalled aluminum tube, or alternatively could be molded integral with the first and second spreaders 16' and 18'. As shown in FIGS. 6 and 7, the hook 112 has a sufficient radius of curvature and length so that it can be positioned to extend around the mooring rail 102 with a free end portion 116 extending through the space between the mooring rail and the dock 13. As is conventional, the mooring rail 102 is positioned raised above the dock to provide a space therebetween through which a line can be passed for tying a boat to the rail.

As with the first embodiment of the invention, the first and second spreaders 16' and 18' also include the tubular engagement member 38 which is fixedly attached to the corresponding retaining member 30 of the spreader by the support rib 43. The construction of the engagement member 38 to provide for releasable insertion of the free end 60 of the spreader arms 54 and 56 is shown in FIG. 8 and is identical to the design shown in FIG. 5 for the first embodiment of the invention.

Also with the first embodiment, the free ends 60 of the first and second spreader arms 54 and 56 are releasable from the recesses 44 of the first and second spreaders 16' and 18' in response to the user pulling the handle 20 in a direction away from the rail 102 with the hooks 112 hooked around the rail. When the predetermined separation force is exceeded, the free ends 60 of the spreader arms 54 and 56 will be released from the recesses 44 of the first and second spreaders 16' and 18', and will allow the hooks 112 to grasp the rail 102 uninhibited by the first and second spreaders, as shown in FIG. 7. In such manner, the user can easily place the hooks 112 around the rail 102 and selectively disconnect the first and second spreaders 16' and 18' from the spreader arms 54 and 58 while still standing on the boat by pulling on the proximal end portion 50 of the shaft 48. The line 14' can simultaneously be pulled taut and the hooks 112 will be secured around the rail 102 for pulling the boat towards the dock 13 and tying the boat to the rail 102.

Preferably, the retaining member 30 and the engagement member 38 are fixedly attached together with an orientation such that, when the engagement members are in position on the free ends 60 of the spreader arms 54 and 56, the hooks 112 will be in a downwardly curving position and arranged substantially parallel to each other. As with the first embodiment of the invention, the first and second spreaders 16' and 18' are held by the spreader arms 54 and 56 in a spaced-apart, substantially parallel alignment having their first ends 32 positioned towards the spreader arms and their second ends 34 positioned away from the spreader arms when the free ends 60 of the spreader arms are inserted within the recesses 44 of the first and second spreaders. Unlike with the line-retaining members of the first embodiment of the invention, it is unnecessary to elongate the line-retaining members 30 beyond the length of the corresponding engagement means 38.

As with the first embodiment of the invention, the user of the apparatus 100 can quickly and more reliably, in a safer manner and with less effort, accomplish grasping of the mooring rail 102 for mooring, purposes while the boat is at a distance from the dock 13 using the long reach provided by the handle 20 of the apparatus 100. The user no longer has to jump to the dock to tie the line around the rail or require the assistance of a person on the dock. The operation of the apparatus 100 is simple and requires no training or special skills. Further, the apparatus 100 of the present invention has an uncomplicated construction and can be manufactured in an economical manner. The apparatus 100 can also be broken down for easy storage.

The apparatus 100 can be sold for use with an already existing line provided by the user so that the user simply needs to buy the first and second spreaders 16' and 18' with the hooks 112 in place. The user can then, using the mooring line he already owns, splice the line to form the two line end segments 104 and 106. A variety of manners of securing the terminal end portion 110 of the first and second line end segments 104 and 106 in the apertures 36 of the retaining members 30 can be provided, such as glue or a mechanical clamping connection (not shown). The user would also have to buy the handle 20 having the spreader arms 54 and 56. Alternatively, the spreader arms 54 and 56 can be manufactured for connection to a handle, boat hook, or other pole already owned by the user. In any event, when assembled, the utilitarian features of the resulting device will be substantially as described and shown herein.

It will be appreciated that, although specific embodiments of the invention have been described herein for purposes of illustration, various modifications may be made without departing from the spirit and scope of the invention. Accordingly, the invention is not to be limited except as by the appended claims.

I claim:

1. An apparatus to assist a user in tying a boat to a mooring rail, comprising:

a line having a first end portion attachable to the boat, a second end portion having first and second end segments, each with a free terminal end portion, and a length of line extending between said first and second end portions;

first and second spreaders, each said spreader being disconnected from the other and having an aperture, said terminal end portion of said line first end segment being fixedly secured in said first spreader aperture and said terminal end portion of said line second end segment being fixedly secured in said second spreader aperture, said first and second spreaders being independently movable relative to the other of said first and second spreaders, each said spreader further having a connection recess and a hook sized to reach at least partially around the mooring rail; and a handle having an elongated shaft with a proximal end portion for grasping by the user and a distal end portion, and further having a pair of spreader arms, each spreader arm having one end rigidly attached to said shaft distal end portion and a free end spaced apart from said free end of the other of said spreader arms by a predetermined distance, said free end of each of said spreader arms being releasably insertable into said recess of a different one of said first and second spreaders to selectively hold said first and second spreaders spaced apart by about said predetermined distance, said free ends of said spreader arms being releasable from said recesses of said first and second spreaders in response to the user pulling said handle in a direction away from the mooring rail with a predetermined separation force with said hooks in place around the mooring rail to allow said hooks to remain hooked around the mooring rail during mooring uninhibited by said first and second spreaders or said spreader arms, whereby the user, while located at a distance from the mooring rail and holding said proximal end portion of said shaft, can easily place said hooks around the mooring rail, and the user can selectively disconnect said first and second spreaders from said spreader arms by pulling on said handle for tying the boat to the mooring rail.

2. The apparatus of claim 1 wherein said first and second spreaders each has a line retaining member with spaced apart first and second ends, and wherein said aperture extends fully between said first and second member end with said line first end segment extending into said aperture of said first spreader at said first member end and said first spreader hook has an end extending into said aperture of said first spreader at said second member end and fixedly secured therein, and with said line second end segment extending into said aperture of said second spreader at said first member end and said second spreader hook has an end extending into said aperture of said second spreader at said second member end and fixedly secured therein, said spreader arms being oriented relative to each other to hold said line retaining members in a spaced apart position with said first and second spreader hooks in substantially parallel alignment with each other, said first member ends being positioned toward said spreader arms and said second member ends being positioned away from said spreader arms when said free ends of said spreader arms are inserted within said recesses of said first and second spreaders, said hooks extending from said first and second spreader apertures in the direction away from said spreader arms.

3. The apparatus of claim 2 wherein said first and second spreaders each has an elongated engagement member with first and second longitudinal ends, said recesses each being a longitudinally extending cavity with an opening at said first engagement member end toward said spreader arms, said free ends of said spreader arms each being an elongated insertion member sized to be inserted into one of said openings of said engagement member cavities and to be tightly retained therein, each of said engagement members being rigidly connected to one of said line retaining members.

4. The apparatus of claim 1, further including attachment detents which prevent disconnection of said first and second spreaders from said spreader arms until said predetermined separation force has been exceeded by the user pulling on said handle with said hooks around the mooring rail.

5. The apparatus of claim 1 wherein each of said free ends of said spreader arms is formed as a pair of resilient fingers sized to be insertable into one of said recesses by yielding movement of said fingers together, and having sufficient resiliency to move said fingers apart once inside said recess to resiliently grasp an interior wall of said recess to prevent removal therefrom until said predetermined separation force is exerted thereon.

6. The apparatus of claim 5 wherein at least one of said fingers of each said spreader arms includes a detent engaging one of said first and second spreaders when said fingers are inserted into said recesses.

7. The apparatus of claim 1, further including alignment means for preventing rotation of said first and second spreaders about said spreader arms when inserted in said recesses.

8. The apparatus of claim 7 wherein said alignment means includes said recesses having an interior wall with a non-symmetrical cross-section and said free ends of said spreader arms having a cross-sectional shape and size to engage said interior wall and prevent rotation of said spreader arms when within said recesses.

9. The apparatus of claim 1 wherein said shaft and said spreader arms are removably attached together, whereby when not in use said apparatus can be broken down into at least two parts for storage.

10. The apparatus of claim 1 wherein said spreader arms have, in combination, a U-shape with a base portion and said shaft distal end portion is attached to said spreader arms at said base portion.

11. An apparatus to assist a user in tying a boat to a mooring rail, comprising:

a line having a first end portion attachable to the boat, a second end portion having first and second end segments, each with a free terminal end portion, and a length of line extending between said first and second end portions;

first and second spreaders, each said spreader being disconnected from the other, said terminal end portion of said line first end segment being secured to said first spreader and said terminal end portion of said line second end segment being secured to said second spreader, each of said first and second spreaders having a hook sized to reach at least partially around the mooring rail;

a handle having a shaft with a proximal end portion for grasping by the user and a distal end portion, and further having a pair of spreader arms, each spreader arm having one end rigidly attached to said shaft distal end portion and a free end spaced apart from said free end of the other of said spreader arms by a predetermined distance, said free end of each of said spreader arms being releasably connectable to a different one of said first and second spreaders to selectively hold said first and second spreaders spaced apart by about said predetermined distance; and a pair of selectively releasable couplings connecting said free ends of said spreader arms to said first and second spreaders, said couplings being releasable in response to the user pulling said handle in a direction away from the mooring rail with a predetermined separation force with said hooks in place around the mooring rail to separate said spreader arms from said first and second spreaders and allow said hoops to hook around the mooring rail, whereby the user, while located at a distance from the mooring rail and holding said proximal end portion of said shaft, can easily place said hooks around the mooring rail, and the user can selectively disconnect said first and second spreaders from said spreader arms by pulling on said handle for tying the boat to the mooring rail.

12. The apparatus of claim 11 wherein said first and second spreaders each has a line retaining portion with spaced-apart first and second ends, and wherein an aperture extends fully between said first and second ends, said line first end segment extending into said aperture of said first spreader at said first end and having said terminal end portion thereof fixedly secured therein, and said line second end segment extending into said aperture of said second spreader at said first end and having said terminal end portion thereof fixedly secured therein, said first spreader hook having an end extending into said aperture of said first spreader at said second end and fixedly secured therein, and said second spreader hook having an end extending into said aperture of said second spreader at said second end and fixedly secured therein, said spreader arms being oriented relative to each other to hold said line retaining portions in a spaced-apart arrangement with said first ends positioned toward said spreader arms and said second ends positioned away from said spreader arms when said free ends of said spreader arms are connected to said first and second spreaders, said hooks extending from said first and second apertures in the direction away from said spreader arms.

13. The apparatus of claim 11 wherein said couplings include an elongated engagement portion having a longitudinally extending cavity with an opening rigidly connected to each of said first and second spreaders, said free ends of said spreader arms each being an elongated insertion member sized to be inserted into one of said engagement portion cavities and to be tightly retained therein to releasably connect said spreader arms to said first and second spreaders.

14. The apparatus of claim 13 wherein said couplings each further includes an attachment detent which prevents removal of said first and second spreaders from said engagement portion cavities until said predetermined separation force has been exceeded by the user pulling on said handle with said hooks around the mooring rail.

15. The apparatus of claim 13 wherein each of said free ends of said spreader arms is formed as a pair of resilient fingers sized to be insertable into one of said engagement portion cavities by yielding movement of said fingers together, and having sufficient resiliency to move said fingers apart once inside said engagement portion cavity to resiliently grasp an interior wall of said engagement portion cavity to prevent removal therefrom until said predetermined separation force is exerted thereon.

16. The apparatus of claim 15 wherein at least one of said fingers of each said spreader arms includes a detent engaging one of said first and second spreaders when said fingers are inserted into said engagement portion cavities.

17. The apparatus of claim 11, further including alignment means for preventing rotation of said first and second spreaders relative to said spreader arms when connected thereto.

18. The apparatus of claim 17 wherein said alignment means includes a recess in each of said first and second spreaders sized to releasably receive therein said free end of one of said spreader arms and having an interior recess wall with a non-symmetrical cross-section and said free ends of said spreader arms having a cross-sectional shape and size to engage said interior wall and prevent rotation of said spreader arms when within said recesses.

19. The apparatus of claim 11 wherein said shaft and said spreader arms are removably attached to whereby when not in use said apparatus can be broken do at least two parts for storage.

20. The apparatus of claim 11 wherein said arms have, in combination, a U-shape with a base portion and said shaft distal end portion is connected to said spreader arms at said base portion.

21. An apparatus to assist a user in tying boat to an object using a line having a first end portion attachable to the boat, a second end portion having second end segments, each with a free terminal end portion, and a length of line extending between the first and second end portions, comprising:

first and second spreaders, each said spreader being disconnected from the other, the terminal end portion the line first end segment being securable to said first spreader and the terminal end portion of the line second end segment being securable to said second spreader, each of said first and second spreaders having a hook projecting therefrom sized to reach at least partially around the object; and a handle having a shaft with a proximal end portion for grasping by the user and a distal end portion, and further having a pair of spreader arms, each spreader arm having one end rigidly attached to said shaft distal end portion and a free end spaced apart from said free end of the other of said spreader arms by a predetermined distance, said free end of each of said spreader arms being releasably connectable to a different one of said first and second spreaders to selectively hold said first and second spreaders spaced apart by about said predetermined distance, said free ends of said spreader arms being selectively disconnectable from said first and second spreaders by the user when the said hooks are in place around the object to allow said hooks to remain hooked around the object uninhibited by said first and second spreaders or said spreader arms, whereby the user, while located at a distance from the object and holding said proximal end portion of said shaft, can easily place said hooks around the object, and the user can selectively disconnect said first and second spreaders from said spreader arms for tying the boat to the object.

22. The apparatus of claim 21 wherein said first and second spreaders each has a line retaining aperture within which the terminal end portion or the corresponding line first or second end segment is securable, said spreader arms being oriented relative to each other to hold said hooks in a spaced-apart arrangement extending away from said spreader arms when said free ends of said spreader arms are connected to said first and second spreaders.

23. The apparatus of claim 21 wherein said first and second spreaders each has an elongated engagement portion having a longitudinally extending cavity with an opening, said free ends of said spreader arms each being an elongated insertion member sized to be inserted into one of said engagement portion cavities and to be tightly retained therein to releasably connect said spreader arms to said first and second spreaders.

24. The apparatus of claim 23, further including attachment detents which prevent removal of said first and second spreader arms from said engagement portion cavities until a predetermined separation force has been applied by the user pulling on said handle in a direction away from the object with said hooks around the object.

25. The apparatus of claim 23 wherein each of said free ends of said spreader arms is formed as a pair of resilient fingers sized to be insertable into one of said engagement portion cavities by yielding movement of said fingers together, and having sufficient resiliency to move said fingers apart once inside said engagement portion cavity to resiliently grasp an interior wall of said engagement portion cavity to prevent removal therefrom until a predetermined separation force has been applied by the user pulling said handle in a direction away from the object with said hooks around the object.

26. The apparatus of claim 25 wherein at least one of said fingers of each of said spreader arms includes a detent engaging one of said first and second spreaders when said fingers are inserted into said engagement portion cavities.

27. The apparatus of claim 21, further including alignment means for preventing rotation of said first and second spreaders relative to said spreader arms when connected thereto.

28. The apparatus of claim 27 wherein said alignment means includes a recess in each of said first and second spreaders sized to releasably receive therein said free end of one of said spreader arms and having an interior recess wall with a non-symmetrical cross-section and said free ends of said spreader arms having a cross-sectional shape and size to engage said interior wall and prevent rotation of said spreader arms when within said recesses.

29. The apparatus of claim 21 wherein said shaft and said spreader arms are removably attached together, whereby when not in use said apparatus can be broken down into at least two parts for storage.

30. The apparatus of claim 21 wherein said spreader arms have, in combination, a U-shape with a base portion and said shaft distal end portion is connected to said spreader arms at said base portion.

31. An apparatus to assist a user in tying a boat to an object using a line having a first end portion attachable to the boat, a second end portion having first and second end segments, each with a free terminal end portion, and a length of line extending between the first and second end portions and using a handle having an elongated shaft with a proximal end portion for grasping by the user and a distal end portion, comprising:

first and second spreaders, each said spreader being disconnected from the other, the terminal end portion or the line first end segment being securable to said first spreader and the terminal end portion of the line second end segment being securable to said second spreader, each of said first and second spreaders having a hook projecting therefrom sized to reach at least partially around the object, said first and second spreaders being independently movable relative to each other, each said spreader further having a connection recess; and a pair of spreader arms, each spreader arm having one end rigidly attachable to the shaft distal end portion and a free end spaced apart from said free end of the other of said spreader arms by a predetermined distance, said free end of each of said spreader arms being releasably insertable into said recess of a different one of said first and second spreaders to selectively hold said first and second spreaders spaced apart by about said predetermined distance, said free ends of said spreader arms being releasable from said recesses of said first and second spreaders in response to the user pulling the handle in a direction away from the object with a determined separation force with said hooks in place around the object to allow said hooks to remain hooked around the object uninhibited by said first and second spreaders or said spreader arms.

32. The apparatus of claim 31 wherein said first and second spreaders each has a line retaining aperture within which the terminal end portion or the corresponding line first or second end segment is securable, said spreader arms being oriented relative to each other to hold said hooks in a spaced-apart, substantially parallel arrangement extending away from said spreader arms when said free ends of said spreader arms are inserted within said recesses of said first and second spreaders.

33. The apparatus of claim 32 wherein said line retaining apertures of said first and second spreaders are elongated extending cavities with a first opening toward said spreader arms sized to receive the corresponding line first and second end segments and a second opening away from said spreader arms into which an attachment end portion of a corresponding one of said hooks is secured.

34. The apparatus of claim 31, further including attachment detents which prevent disconnection of said first and second spreaders from said spreader arms until said predetermined separation force has been exceeded by the user pulling on the handle with said hooks around the object.

35. The apparatus of claim 31 wherein each of said free ends of said spreader arms is formed as a pair of resilient fingers sized to be insertable into one of said recesses by yielding movement of said fingers together, and having sufficient resiliency to move said fingers apart once inside said recess to resiliently grasp an interior wall of said recess to prevent removal therefrom until said predetermined separation force is exerted thereon.

36. The apparatus of claim 35 wherein at least one of said fingers of each said spreader arms includes a detent engaging one of said first and second spreaders when said fingers are inserted into said recesses.

37. The apparatus of claim 31, further including alignment means for preventing rotation of said first and second spreaders about said spreader arms when inserted in said recesses.

38. The apparatus of claim 37 wherein said alignment means includes said recesses having an interior wall with a non-symmetrical cross-section and said free ends of said spreader arms having a cross-sectional shape and size to engage said interior wall and prevent rotation of said spreader arms when within said recesses.

39. The apparatus of claim 31 wherein said spreader arms are removably attachable to the shaft, whereby when not in use the handle can be separated from said spreader arm for storage.

40. The apparatus of claim 31 wherein said spreader arms have, in combination, a U-shape with a base portion and the shaft distal end portion is attachable to said spreader arms at said base portion.

41. An apparatus to assist a user in tying a boat to an object using a line having a first end portion attachable to the boat, a second end portion having first and second end segments, each with a free terminal end portion, and a length of line extending between the first and second end portions and using a handle with a proximal end portion for grasping by the user and a distal end portion, comprising:

first and second spreaders, each said spreader being disconnected from the other, the terminal end portion of the line first end segment being securable to said first spreader and the terminal end portion of the line second end segment being securable to said second spreader, each of said first and second spreaders having a hook projecting therefrom sized to reach at least partially around the object; and a pair of spreader arms, each spreader arm having one end rigidly attached to the handle distal end portion and a free end spaced apart from said free end of the other of said spreader arms by a predetemined distance, said free end of each of said spreader arms being releasably connectable to a different one of said first and second spreader to selectively hold said first and second spreaders spaced apart by about said predetermined distance, said free ends of said spreader arms being selectively disconnectable from said first and second spreaders by the user when said hooks are in place around the object to allow said hooks to remain hooked around the object uninhibited by said first and second spreaders or said spreader arms, whereby the user, while located at a distance from the object and holding the proximal end portion of the shaft, can easily place said hooks around the object, and the user can selectively disconnect said first and second spreaders from said spreader arms for tying the boat to the object.

42. The apparatus of claim 41 wherein said first and second spreaders each has a line retaining aperture within which the terminal end portion of the corresponding line first or second end segment is securable, said spreader arms being oriented relative to each other to hold said hooks in a spaced-apart, substantially parallel arrangement extending away from said spreader arms when said free ends of said spreader arms are connected to said first and second spreaders.

43. The apparatus of claim 42 wherein said line retaining apertures of said first and second spreaders are elongated extending cavities with a first opening toward said spreader arms sized to receive the corresponding line first and second end segments and a second opening away from said spreader arms into which an attachment end portion of a corresponding one of said spreader hooks is secured.

* * * * *

UNITED STATES PATENT AND TRADEMARK OFFICE

CERTIFICATE OF CORRECTION

PATENT NO. : 5,116,260

DATED : May 26, 1992

INVENTOR(S) : Paul E. Upchurch

It is certified that error appears in the above-identified patent and that said Letters Patent is hereby corrected as shown below:

In column 9, claim 2, line 5, after "member" please delete "end" and substitute therefor -- ends --.

In column 11, claim 19, line 50, please delete "to" and substitute therefor -- together, --.

In column 11, claim 19, line 51, please delete "do" and substitute therefor -- down into --.

In column 11, claim 20, line 53, after "said" please insert -- spreader --.

In column 11, claim 21, line 57, after "tying" please insert -- a --.

In column 11, claim 21, line 59, after "having" please insert -- first and --.

In column 11, claim 21, line 65, before "the" please insert -- of --.

In column 13, claim 31, line 32, please delete "or" and substitute therefor -- of --.

In column 13, claim 32, line 61, please delete "or" and substitute therefor -- of --.

UNITED STATES PATENT AND TRADEMARK OFFICE

CERTIFICATE OF CORRECTION

PATENT NO. : 5,116,260

DATED : May 26, 1992

INVENTOR(S) : Paul E. Upchurch

It is certified that error appears in the above-indentified patent and that said Letters Patent is hereby corrected as shown below:

In column 13, claim 32, line 61, please delete "or" and substitute therefor --of--.

Signed and Sealed this

Seventh Day of September, 1993

Bruce Lehman

*Attest:*

BRUCE LEHMAN

*Attesting Officer*

*Commissioner of Patents and Trademarks*